US008721752B2

(12) United States Patent
Fuller et al.

(10) Patent No.: US 8,721,752 B2
(45) Date of Patent: May 13, 2014

(54) PDC CUTTER WITH STRESS DIFFUSING STRUCTURES

(75) Inventors: John Michael Fuller, Bristol (GB); Douglas Caraway, Conroe, TX (US); Graham Richard Watson, Gloucester (GB)

(73) Assignee: Reedhycalog UK Limited (GB)

( * ) Notice: Subject to any disclaimer, the term of this patent is extended or adjusted under 35 U.S.C. 154(b) by 879 days.

(21) Appl. No.: 12/672,927

(22) PCT Filed: Aug. 14, 2008

(86) PCT No.: PCT/GB2008/002739
§ 371 (c)(1), (2), (4) Date: May 6, 2010

(87) PCT Pub. No.: WO2009/024752
PCT Pub. Date: Feb. 26, 2009

(65) Prior Publication Data

US 2011/0212303 A1 Sep. 1, 2011

Related U.S. Application Data

(60) Provisional application No. 60/956,519, filed on Aug. 17, 2007.

(30) Foreign Application Priority Data

Aug. 21, 2007 (GB) ..... 0716268.8

(51) Int. Cl.
*B24D 3/02* (2006.01)
*B24D 3/00* (2006.01)
*E21B 10/36* (2006.01)

(52) U.S. Cl.
USPC ..... 51/307; 51/293; 175/433; 175/426; 175/428; 175/432; 175/420.2

(58) Field of Classification Search
USPC ..... 51/293, 307; 428/157, 167, 172, 213; 175/433, 426, 428, 432, 420.2
See application file for complete search history.

(56) References Cited

U.S. PATENT DOCUMENTS 2,992,900 A 7/1961 Bovenkerk
3,141,746 A 7/1964 De Lai (Continued)

FOREIGN PATENT DOCUMENTS

CA 2 423 099 3/2002
EP 1190791 B1 3/2002

(Continued)

OTHER PUBLICATIONS

GB0814837.1 Search Report (Sep. 8, 2008).

(Continued)

*Primary Examiner* — Shuangyi Abu Ali
(74) *Attorney, Agent, or Firm* — JL Salazar Law Firm

(57) ABSTRACT

A PCD cutting element for use in earth boring drill bits where die interstices remote from the working surface are filled with a catalyzing material and the interstices adjacent to the working surface are substantially free of the catalyzing material is described. An intermediate region between the substantially free portion and filled portion has a plurality of generally conically sectioned catalyst-free projections which taper down, extending to a second depth from the planar working surface, preferably about 0.5 times or more of the first depth.

16 Claims, 13 Drawing Sheets

(56) References Cited

U.S. PATENT DOCUMENTS

| | | | | |
|---|---|---|---|---|
| 3,141,885 | A | 7/1964 | Ross et al. | |
| 3,148,161 | A | 9/1964 | Bovenkerk et al. | |
| 3,574,580 | A | 4/1971 | Stromberg et al. | |
| 3,744,982 | A | 7/1973 | Bovenkerk et al. | |
| 3,831,428 | A | 8/1974 | Wentorf, Jr. et al. | |
| 3,913,280 | A | 10/1975 | Hall | |
| 4,224,380 | A * | 9/1980 | Bovenkerk et al. | 428/545 |
| 4,268,276 | A | 5/1981 | Bovenkerk | |
| 4,288,248 | A | 9/1981 | Bovenkerk et al. | |
| 4,534,773 | A | 8/1985 | Phaal et al. | |
| 5,011,509 | A | 4/1991 | Frushour | |
| 5,011,514 | A | 4/1991 | Cho et al. | |
| 5,106,391 | A | 4/1992 | Lloyd | |
| 5,127,923 | A | 7/1992 | Bunting et al. | |
| 5,433,280 | A | 7/1995 | Smith | |
| 5,510,193 | A | 4/1996 | Cerutti et al. | |
| 5,544,550 | A | 8/1996 | Smith | |
| 5,645,617 | A | 7/1997 | Frushour | |
| 5,776,615 | A | 7/1998 | Wong et al. | |
| 5,839,329 | A | 11/1998 | Smith et al. | |
| 5,848,657 | A * | 12/1998 | Flood et al. | 175/426 |
| 5,957,006 | A | 9/1999 | Smith | |
| 5,981,057 | A | 11/1999 | Collins | |
| 6,041,875 | A | 3/2000 | Rai et al. | |
| 6,045,440 | A | 4/2000 | Johnson et al. | |
| 6,063,333 | A | 5/2000 | Dennis | |
| 6,068,913 | A * | 5/2000 | Cho et al. | 428/212 |
| 6,193,001 | B1 | 2/2001 | Eyre et al. | |
| 6,200,514 | B1 | 3/2001 | Meister | |
| 6,209,420 | B1 | 4/2001 | Butcher et al. | |
| 6,353,771 | B1 | 3/2002 | Southland | |
| 6,454,030 | B1 | 9/2002 | Findley et al. | |
| 6,544,308 | B2 | 4/2003 | Griffin et al. | |
| 6,601,662 | B2 | 8/2003 | Matthias et al. | |
| 6,655,481 | B2 | 12/2003 | Findley et al. | |
| 6,852,414 | B1 | 2/2005 | Frushour | |
| 6,861,098 | B2 | 3/2005 | Griffin et al. | |
| 7,384,436 | B2 | 6/2008 | Sung | |
| 7,407,012 | B2 | 8/2008 | Keshavan et al. | |
| 7,435,478 | B2 | 10/2008 | Keshavan | |
| 7,493,973 | B2 | 2/2009 | Keshavan et al. | |
| 7,533,740 | B2 | 5/2009 | Zhang et al. | |
| 7,588,108 | B2 | 9/2009 | Miyao | |
| 7,862,634 | B2 | 1/2011 | Belnap et al. | |
| 7,862,932 | B2 | 1/2011 | Eguchi et al. | |
| 7,963,348 | B2 | 6/2011 | Laird et al. | |
| 7,972,409 | B2 | 7/2011 | Fujino et al. | |
| 2005/0044800 | A1 | 3/2005 | Hall et al. | |
| 2005/0115744 | A1 | 6/2005 | Griffin et al. | |
| 2006/0060390 | A1 * | 3/2006 | Eyre | 175/432 |
| 2006/0060391 | A1 | 3/2006 | Eyre et al. | |
| 2006/0060392 | A1 | 3/2006 | Eyre | |
| 2006/0165993 | A1 | 7/2006 | Keshavan | |
| 2006/0191723 | A1 | 8/2006 | Keshavan | |
| 2006/0207802 | A1 | 9/2006 | Zhang et al. | |
| 2006/0266559 | A1 | 11/2006 | Keshavan et al. | |
| 2007/0039762 | A1 | 2/2007 | Achilles | |
| 2007/0277651 | A1 | 12/2007 | Calnan et al. | |
| 2008/0028891 | A1 | 2/2008 | Calnan et al. | |
| 2008/0142275 | A1 | 6/2008 | Griffin et al. | |
| 2009/0166094 | A1 | 7/2009 | Keshavan et al. | |
| 2009/0173015 | A1 * | 7/2009 | Keshavan et al. | 51/307 |
| 2010/0200305 | A1 | 8/2010 | Griffin et al. | |
| 2010/0330357 | A1 | 12/2010 | Davies et al. | |
| 2011/0212303 | A1 | 9/2011 | Fuller et al. | |

FOREIGN PATENT DOCUMENTS

| | | | |
|---|---|---|---|
| EP | 2453435 | A1 | 5/2012 |
| EP | 2455425 | A1 | 5/2012 |
| GB | 2423542 | A | 8/2006 |
| GB | 2 433 525 | | 6/2007 |
| GB | 2467570 | | 8/2010 |
| UA | 74 010 | | 7/2003 |
| WO | 0224601 | A1 | 3/2002 |
| WO | 0224603 | A1 | 3/2002 |

OTHER PUBLICATIONS

PCT Search Report for counterpart PCT Publication No. WO 2009/024752 published May 27, 2010, 4 pages.

PCT Written Opinion for counterpart PCT Publication No. WO 2009/024752 dated Apr. 9, 2010, 5 pages.

SPS, 'What's SPS?' [online], 8 pages, Japan, [retreived Oct. 24, 2011], Retreived from Internet <URL: http://www.scm-sps.com/e_htm/whatspse_htm/whatsspse.htm>.

Search Report for counterpart GB Patent Application No. GB0901984.5 dated Jun. 25, 2009, 5 pages.

Examination Report for counterpart GB Patent Application No. GB0901984.5 dated May 11, 2012, 1 page.

* cited by examiner

PDC CUTTER WITH STRESS DIFFUSING STRUCTURES

This invention relates to superhard polycrystalline diamond (PCD) elements for wear and cutting applications and particularly as cutting elements for earth boring drill bits where engineered superhard surfaces are needed. The invention particularly relates to PCD elements with working surfaces partially depleted of catalyzing material that have greatly improved wear resistance while maintaining excellent impact resistance.

A well known, manufactured form of PCD element is a two-layer or multi-layer PCD element where a facing table of polycrystalline diamond is integrally bonded to a substrate of less hard material, such as tungsten carbide. The PCD element may be in the form of a circular or part-circular tablet, or may be formed into other shapes, suitable for applications such as hollow dies, heat sinks, friction bearings, valve surfaces, indentors, tool mandrels, etc. PCD elements of this type may be used in almost any application where a hard wear and erosion resistant material is required. The substrate of the PCD element may be brazed to a carrier, often also of cemented tungsten carbide. This is a common configuration for PCD's used as cutting elements, for example in fixed cutter or rolling cutter earth boring bits when received in a socket of the drill bit, or when fixed to a post in a machine tool for machining. These PCD elements are typically called polycrystalline diamond cutters (PDC), and the surfaces of the PCD that contact the material to be modified are called working surfaces.

It has become well known that the cutting properties of these PCD materials are greatly enhanced when a relatively thin layer of the diamond material adjacent to the working surface is treated to remove the catalyzing material that remains there from the manufacturing process. This has been a relatively thin layer, generally from about 0.05 mm to about 0.4 mm thick, and the depth from the working surface tends to be generally uniform. This type of PDC cutting element has now become nearly universally used as cutting elements in earth boring drill bits and has caused a very significant improvement in drill bit performance.

Because these surfaces tend to be planar, however, it has been observed that fracture adjacent to the treated layer may occur. It has been speculated that the often lenticular type of fracture may be related to stresses that form in the area between the depleted and non-depleted regions. It is believed that stress concentrations in this 'transition' region may lead to these fractures.

According to the present invention there is provided a polycrystalline diamond cutting element comprising a plurality of partially bonded diamond crystals with interstices disposed therebetween and formed with a substrate of less hard material, the cutting element having a formation engaging working surface, the interstices adjacent to the working surface and to a first depth from the working surface being substantially free of the catalyzing material, the interstices remote from the working surface containing a catalyzing material, an intermediate region of the cutting element being formed with at least one substantially catalyst-free projection extending to a second depth from the working surface greater than the first depth.

In one embodiment a plurality of stress disruption features are formed in PDC cutting elements for use in earth boring drill bits. These cutting elements for drilling earthen formations, have a plurality of partially bonded diamond crystals with interstices disposed therebetween and are formed with a substrate of less hard material. The cutting element also has a generally planar end formed adjacent a generally cylindrical periphery, and a formation engaging working surface on the end and the periphery.

The interstices remote from the working surface are filled with a catalyzing material, and the interstices adjacent to the working surface are substantially free of the catalyzing material. An intermediate region between the substantially free portion and filled portion has a plurality of generally conically sectioned catalyst-free projections which taper down, extending to a second depth from the planar working surface at least about 0.5 times the first depth.

The invention will further be described, by way of example, with reference to the accompanying drawings, in which:

FIGS. 7A and 7B to 16A and 16B are views similar to FIGS. 6A and 6B but illustrating a variety of other embodiments.

Figure 1A:
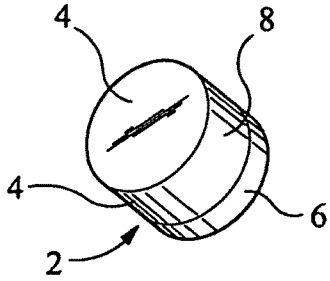
FIG. 1A is a typical PCD element of the present invention.
Figure 3:
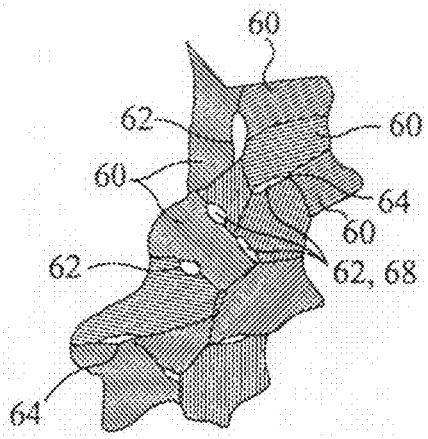
FIG 3 (PRIOR ART)
FIG. 3 is a micro-structural representation of a PCD element of the prior art, showing the bonded diamond crystals, with the interstitial regions and the random crystallographic orientation of the individual crystals.
Figure 4:
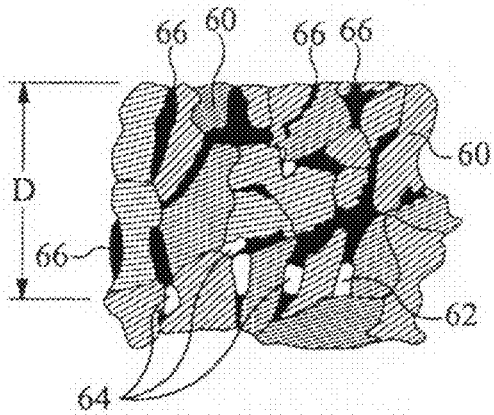
FIG 4 (PRIOR ART)
FIG. 4 is a micro-structural representation of another PCD element of the more recent prior art similar to that shown in FIG. 3, indicating the depth of the catalyzing material free region relative to the surface of the PCD element.

A typical polycrystalline diamond or diamond-like material (PCD) element 2 is generally shown in FIG. 1A. The PCD element 2 has a plurality of partially bonded superhard, diamond or diamond-like, crystals 60, (shown in the prior art FIGS. 3 and 4) a catalyzing material 64, and an interstitial matrix 68 formed by the interstices 62 among the crystals 60. The element 2 also has one or more working surfaces 4 and the diamond crystals 60 and the interstices 62 form the volume of the body 8 of the PCD element 2. Preferably, the element 2 is integrally formed with a metallic substrate 6, typically tungsten carbide with a cobalt binder material. The typical volume density of the diamond in the body 8 is typically greater than 85 volume %, and preferably higher than 90%.

The working surface 4 is any portion of the PCD body 8 which, in operation, may contact the object to be worked. In this specification, when the working surface 4 is discussed, it is understood that it applies to any portion of the body 8 which may be exposed and/or used as a working surface. Furthermore, any portion of any of the working surface 4 is, in and of itself, a working surface.

PCD's of both the prior art and the present invention are made under conditions of high-temperature and high-pressure (HTHP). During this process the interstices 62 among the crystals 60 fill with the catalyzing material 64 followed by bonds forming among the crystals 60. In a further step of the manufacture, some of the catalyzing material 64 is selectively depleted from some of the interstices 62. The result is that a first volume of the body 8 of the PCD element 2 remote from the working surface 4 contains the catalyzing material 64, and a second volume of the body 8 adjacent to the working surface 4 is substantially free of the catalyzing material 64 to a depth 'D'. The interstices 62 which are substantially free of the catalyzing material 64 to the depth 'D' are indicated by numeral 66.

In this specification, when the term 'substantially free' is used referring to catalyzing material 64 in the interstices 62, the interstitial matrix 68, or in a volume of the body 8, it should be understood that many, if not all, the surfaces of the adjacent diamond crystals 60 may still have a coating of the catalyzing material 64. Likewise, when the term 'substantially free' is used referring to catalyzing material 64 on the surfaces of the diamond crystals 60, there may still be catalyzing material 64 present in the adjacent interstices 62.

Because the body adjacent to the working surface 4 is substantially free of the catalyzing material 64, the deleterious effects of the binder-catalyzing material 64 are substantially decreased, and thermal degradation of the working surface 4 due to the presence of the catalyzing material 64 is effectively eliminated, as is now well known in the art.

Figure 2:
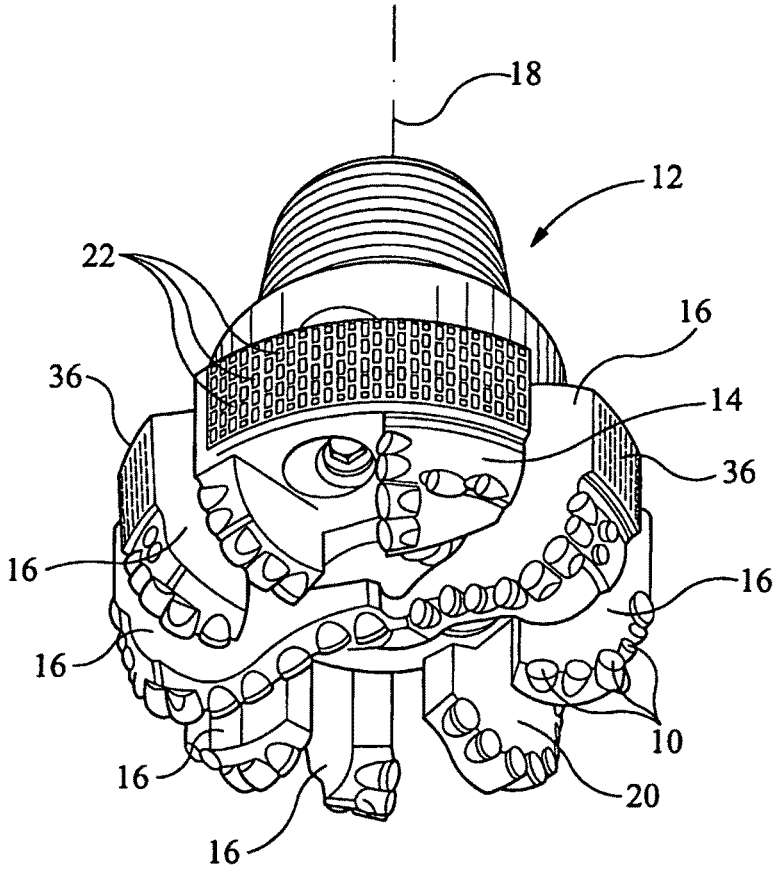
FIG. 2 is a perspective view of a fixed cutter rotary drill bit using a PCD element of the present invention.

The PCD cutting element 10 may be a preform cutting element 10 of a fixed cutter rotary drill bit 12 (as shown in FIG. 2). The bit body 14 of the drill bit is formed with a plurality of blades 16 extending generally outwardly away from the central longitudinal axis of rotation 18 of the drill bit. Spaced apart side-by-side along the leading face 20 of each blade is a plurality of the PCD cutting elements 10 of the present invention. Other types of wear resistant elements 22 may also be applied to the gauge region 36 of the bit 12 to provide a gauge reaming action as well as protecting the bit 12 from excessive wear in the gauge region 36.

Figure 1B:
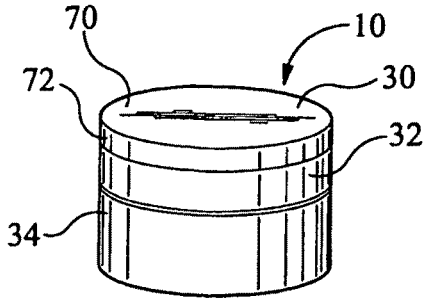
FIG. 1B is a typical PCD of the present invention shown as a cutting element.

Typically, the PCD cutting element 10 has a body in the form of a circular tablet (see FIG. 1B) having a thin front facing table 30 of diamond or diamond-like (PCD) material, bonded in a high-pressure high-temperature press to a substrate 32 of less hard material such as cemented tungsten carbide or other metallic material. The cutting element 10 is preformed and then typically bonded on a generally cylindrical carrier 34 which is also formed from cemented tungsten carbide, or may alternatively be attached directly to the blade. The PCD cutting element 10 has working surfaces 70 and 72.

The cylindrical carrier 34 is received within a correspondingly shaped socket or recess in the blade 16. The carrier 34 will usually be brazed or shrink fit in the socket. In operation the fixed cutter drill bit 12 is rotated and weight is applied. This forces the cutting elements 10 into the earth being drilled, effecting a cutting and/or drilling action.

In the process of bonding the crystals 60 in a high-temperature, high-pressure press, the interstices 62 among the crystals 60 become filled with a binder-catalyzing material 64, typically cobalt or other group VIII element. It is this catalyzing material 64 that allows the bonds to be formed between adjacent diamond crystals 60 at the relatively low pressures and temperatures present in the press.

Figure 5:
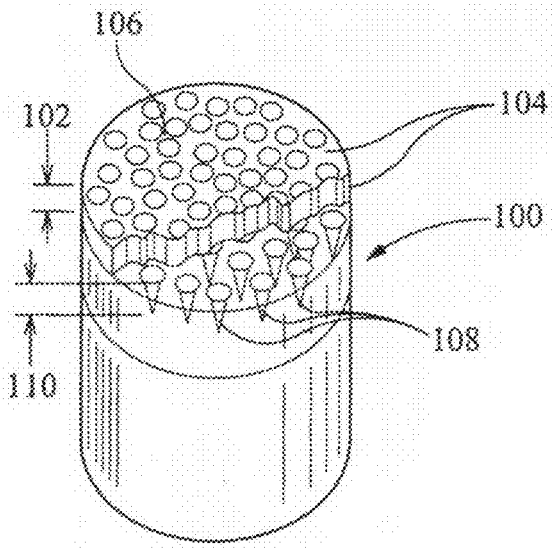
FIG. 5 is a partial section view of the diamond layer of the present invention showing the separated, generally conical projections into the diamond layer below the depth of the catalyzing material free region relative to the surface of the PCD element.

Referring now to FIG. 5, shown is a partial cross section view of the PDC cutting element 100 of the present invention. The PCD element 100 may be formed in the same manner as the prior art PCD elements described above. After a preliminary cleanup operation or at any time thereafter in the process of manufacturing, the working surface 104 of the PDC cutting element 100 is processed in a manner very similar to that shown in FIGS. 3 and 4 of the prior art—which removes a portion of the binder-catalyzing material from the adjacent body. The result is that the interstices 62 among the diamond crystals 60 adjacent to the working surface are substantially free of the catalyzing material 64 indicated by numeral 66.

There are many methods for removing or depleting the catalyzing material 64 from the interstices 62. In one method, the catalyzing material 64 is cobalt or other iron group material, and the method of removing the catalyzing material 64 is to leach it from the interstices 62 near the working surface 104 of the PDC cutting element 100 in an acid etching process. It is also possible that the method of removing the catalyzing material 64 from near the surface may be by electrical discharge or other electrical or galvanic process or by evaporation. Many other methods and apparatus are well known or have been contemplated by those skilled in the art. Further explanation and details of these prior art cutters and cutting elements may be found in the published International Patent Application No. PCT/GB01/03986 and also in U.S. Pat. No. 6,544,308 which is incorporated by reference herein for all it discloses.

In prior art cutters, however, it has been found that fractures adjacent to this layer may occur. It is believed that these lenticular types of fractures may be related to stresses that form in the area between the depleted and non-depleted regions and that stress concentrations in this 'transition' region may lead to these fractures.

In the present invention the working surface 104 is treated to a first depth 102 from about 0.05 mm to about 0.5 mm from the planar portion 106 of the working surface 104, as described above. However, beneath this first depth are a plurality of projections 108 depleted of catalyzing material in the PDC material which help prevent the above described fractures. In FIG. 5, these are shown as a number of generally conically shaped projections 108. However, these projections 108 may be of any shape provided they project to a second depth 110 below the first depth 102. This second depth may be an additional 0.05 mm to about 0.5 mm below the first depth 102, for a total depth from the planar working surface 106 of 0.1 mm to about 1.0 mm. However, it is believed that the preferred second depth should be at least about 0.5 or more of the first depth. In the arrangement of FIG. 5, the projections 108 taper or reduce in cross-section as the distance from the first depth increases. However, other shapes are possible.

Figure 6A:
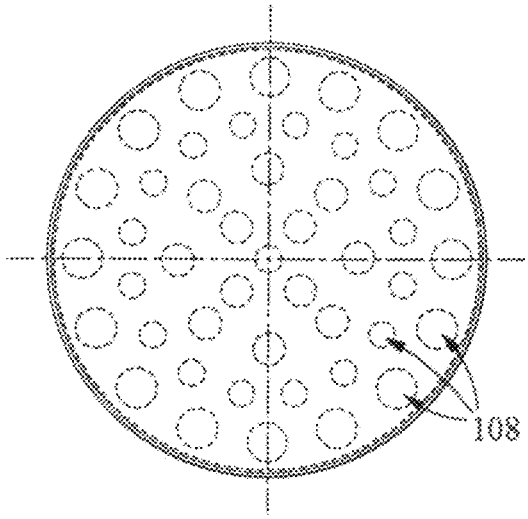
FIGS. 6A and 6B are diagrammatic plan and side views illustrating a PCD element similar to that shown in FIG. 5.
Figure 6B:
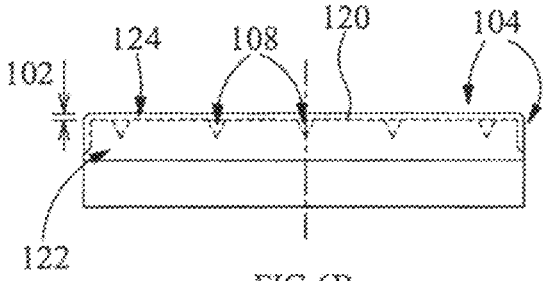

FIGS. 6A and 6B are diagrammatic plan and side views illustrating an arrangement similar to that of FIG. 5. In FIGS. 6A and 6B, the projections 108 are illustrated by dashed or broken lines to indicate that they are not visible from the exterior of the cutter. The boundary 120 at the first depth 102 between the region 122 remote from the working surface 104 and containing catalyzing material and the region 124 closer to the working surface 104 and treated to have catalyzing material removed therefrom is also not normally visible in the arrangement illustrated. As shown in FIGS. 6A and 6B, the projections 108 are of a variety of different diameters. However this need not be the case. The projections 108 may be arranged uniformly, in a chosen pattern, or may be non-uniformly distributed.

Figure 7A:
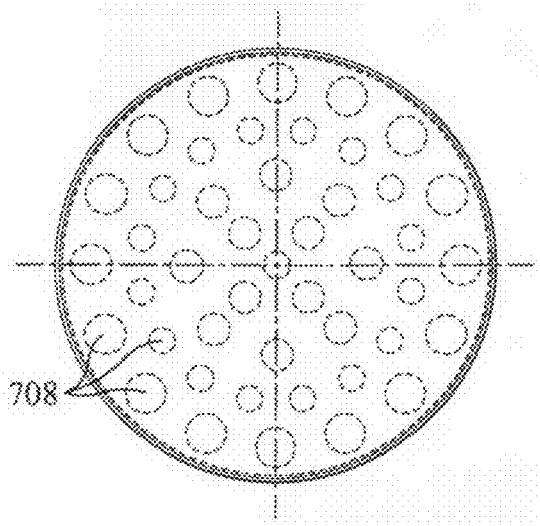
Figure 7B:
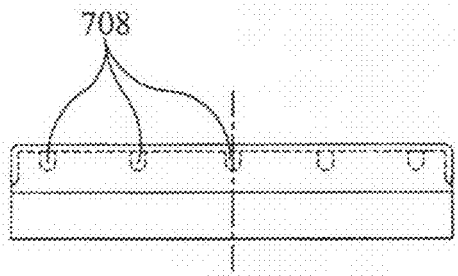
Figure 8A:
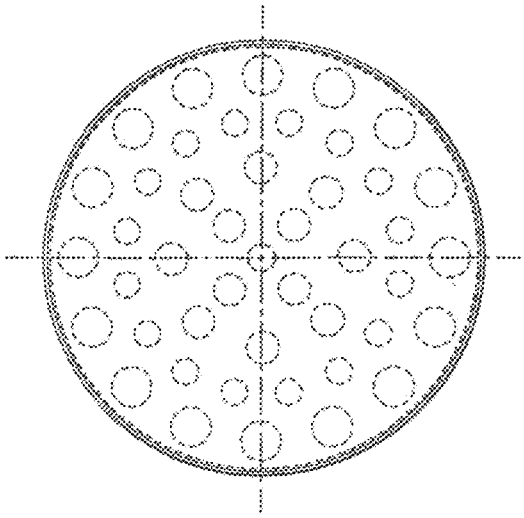
Figure 8B:
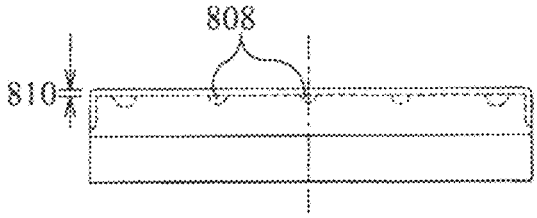

FIGS. 7A and 7B illustrate an arrangement similar to that of FIGS. 6A and 6B, but in which the projections 708 are of part spherical or part ellipsoidal form. FIGS. 8A and 8B illustrate an arrangement similar to FIGS. 7A and 7B, but in which the first depth 802 is shallower, thus the projections 808 are smaller.

Figure 9A:
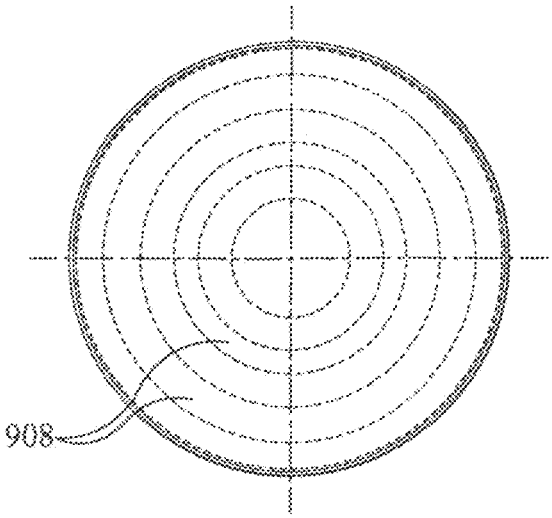
Figure 9B:
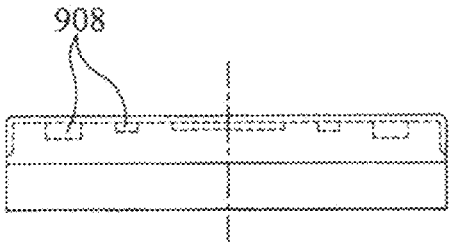

FIGS. 9A and 9B illustrate an arrangement in which the projections 908 comprise a series of concentric annular rings. The projections 908 in the arrangement illustrated are of parallel sided form, but they could be of, for example, tapering, part spherical or part ellipsoidal form, if desired. Also, they need not be arranged concentrically.

Figure 10A:
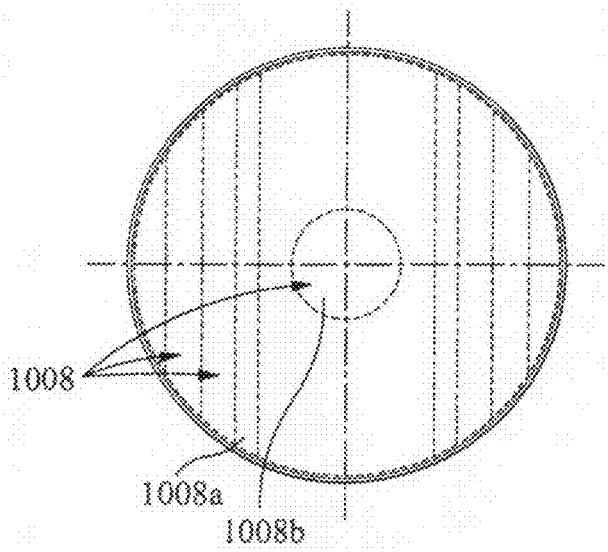
Figure 10B:
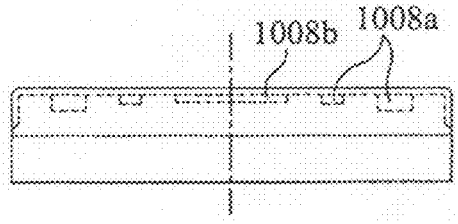

FIGS. 10A and 10B show an arrangement in which the projections 1008 are in the form of a series of parallel ridges

Figure 11A:
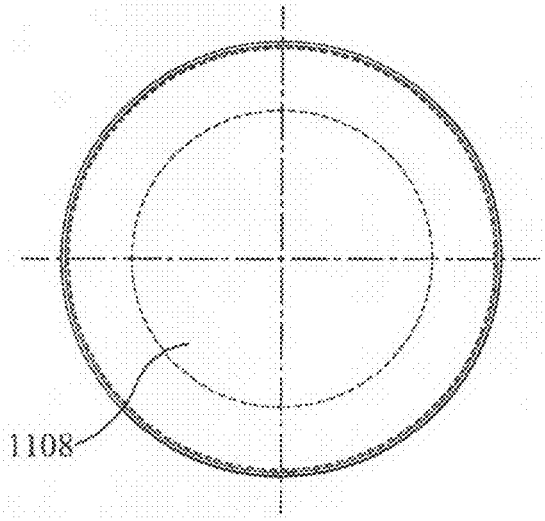
Figure 11B:
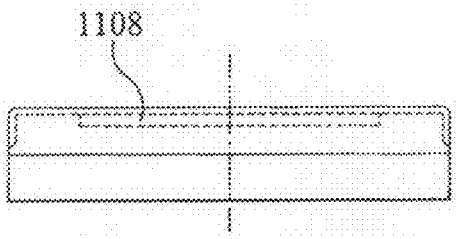

1008*a* and a central circular formation 1008*b*. FIGS. 11A and 11B show an arrangement in which the projection 1108 comprises a relatively large diameter central circular formation. As with the arrangements described hereinbefore, although shown as being of parallel sided form, tapering, part spherical, part ellipsoidal or other forms may be used.

Figure 12A:
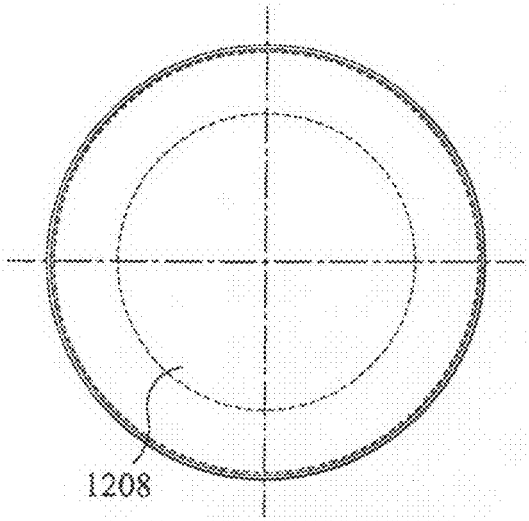
Figure 12B:
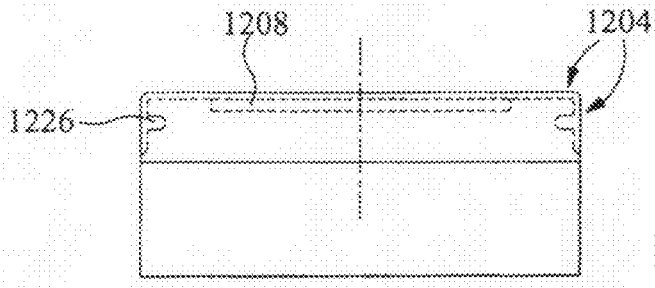

FIGS. 12A and 12B illustrate a variant to that of FIGS. 11A and 11B in which an additional projection 1226 extends inwardly from a side part of the working surface 1204. Similar modifications can be made to the other arrangements described hereinbefore.

Figure 13A:
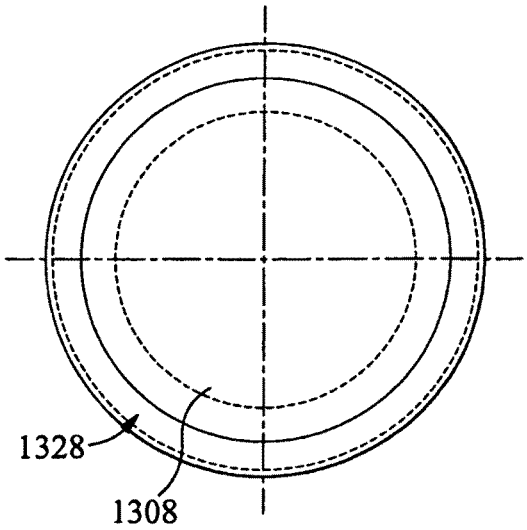
Figure 13B:
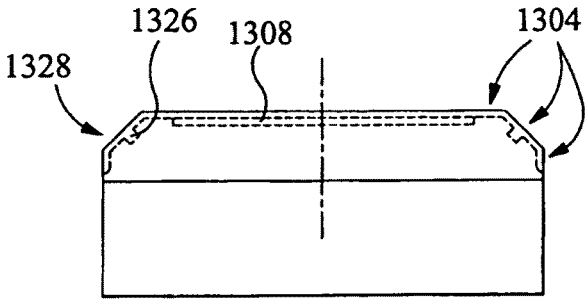
Figure 14A:
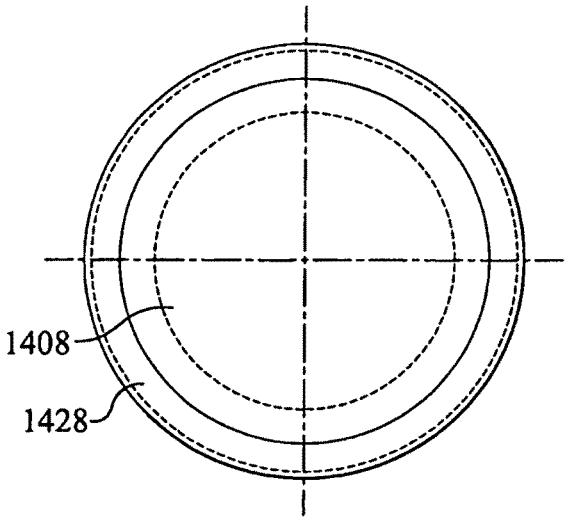
Figure 14B:
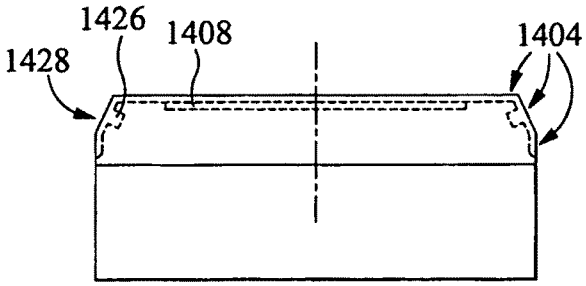

FIGS. 13A and 13B show another variant to the arrangement of FIGS. 11A and 11B, but in which a chamfer 1328 is formed on the working surface 1304. The chamfer 1328 is provided with an additional projection 1326. FIGS. 14A and 14B illustrate a variant in which the chamfer 1428 is formed at a different angle.

Figure 15A:
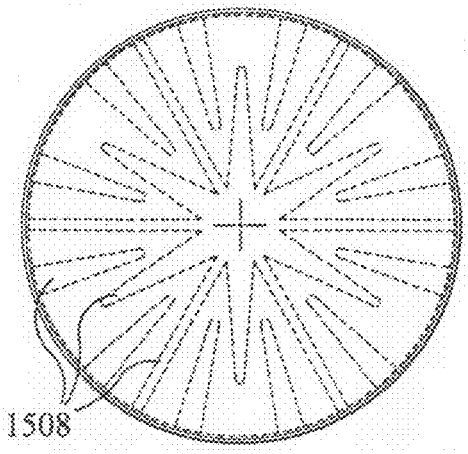
Figure 15B:
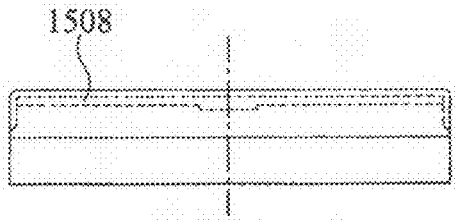

FIGS. 15A and 15B illustrate an arrangement in which the projections 1508 comprise a series of ridges arranged to form a star-like configuration. Some of the ridges extend across substantially the full diameter of the cutter, others stopping short of the centre of the cutter, and still others extending from the centre of the cutter, but stopping short of the periphery thereof.

Figure 16A:
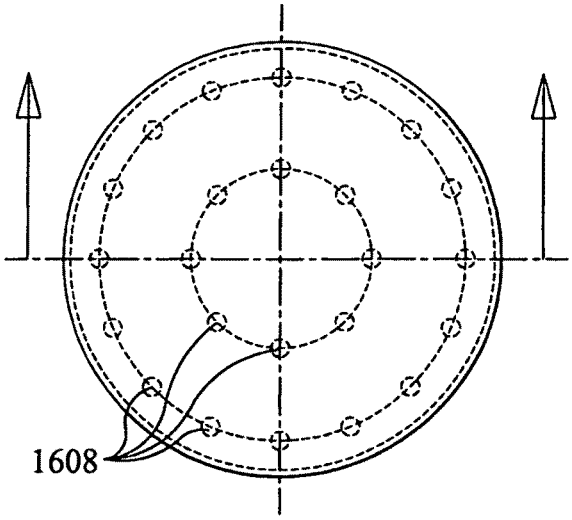
Figure 16B:
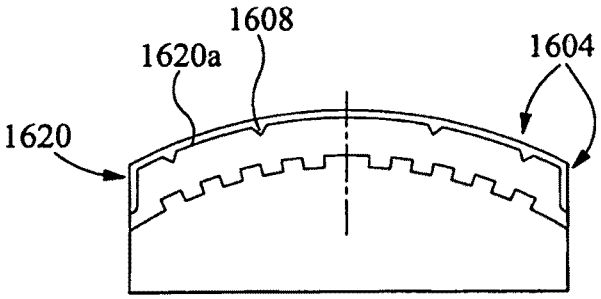

All of the arrangements described hereinbefore are of cutters having at least a substantially planar working surface region. The invention is also applicable to arrangements in which the cutter is of domed form, for example as shown in FIGS. 16A and 16B. It will be recognized that, in such an arrangement, the boundary 1620 which is at a substantially uniform depth from the working surface 1604 will also include a domed part 1620*a*. Any of the variants described hereinbefore may be made to the domed arrangement of FIGS. 16A and 16B.

There are numerous ways to form these projections 108, . . . , 1608. In one embodiment, the PDC cutter may be masked in a manner such that the working surface exposed to the acid bath (described above) is 'windowed' through a plurality of openings in the mask. These openings may be of any convenient shape or size, and function so as to allow the acid to leach only the selected areas. The leaching may progress for hours or days, as may be required, for the desired geometry of the projections 108, 1608.

Once the projections 108, . . . , 1608 have been formed, a second leaching operation may be performed which removes substantially all of the catalyzing material from the surface to the required first depth 102, . . . , 1602 and causes further growth of the projections 108, . . . , 1608 to the second depth 110, . . . , 1610 below the first depth 102, . . . , 1602.

It is believed that these projections reduce stress induced fractures in the region depleted of catalyzing material to the first depth 102, . . . , 1602 because they provide a far more gradual transition from the depleted to non-depleted regions in the PDC, and therefore remove the abrupt transition from the catalyst free zone to the catalyst filled zone. Therefore, the stresses that form in the area between the depleted and non-depleted regions during operation of the PDC in operation are substantially mitigated.

Whereas the present invention has been described in particular relation to the drawings attached hereto, it should be understood that other and further modifications apart from those shown or suggested herein, may be made within the scope and spirit of the present invention. For example, some of the projections could extend to different depths. In the embodiment of, say, FIGS. 7A and 7B, some of the projections could extend to the second depth, and others could extend to a third, deeper depth, or in the arrangement of FIGS. 15A and 15B, the projections need not be of uniform depth along their entire length. Alternatively, at least some of the arrangements described hereinbefore could be modified to include further features projecting from the projection(s) to a third depth. For example, in the arrangement of FIGS. 11A and 11B, additional features could project from the circular formation 1108. These additional features could take any of the forms described herein, for example comprising tapering conical or part spherical formations.

The invention claimed is:

1. A polycrystalline diamond cutting element comprising a plurality of partially bonded diamond crystals with interstices disposed therebetween and formed with a substrate of less hard material, the cutting element having a formation engaging working surface, the interstices adjacent to the working surface and to a first depth from the working surface being substantially free of the catalyzing material, the interstices remote from the working surface containing a catalyzing material, at least one substantially catalyst-free projection extending below the first depth and to a second depth, the at least one projection being a distance from the working surface.

2. A cutting element according to claim 1, wherein the at least one projection is of reducing cross-sectional area with increasing distance from the first depth.

3. A cutting element according to claim 1, wherein the second depth is at least 0.5 times greater than the first depth.

4. A cutting element according to claim 1, wherein the first depth falls in the range of 0.05 mm to 0.5 mm.

5. A cutting element according to claim 1, wherein the second depth falls in the range of 0.1 mm to 1.0 mm.

6. A cutting element according to claim 1, wherein the at least one projection comprises a plurality of projections.

7. A cutting element according to claim 1, wherein the at least one projection comprises at least one ridge, and wherein the at least one ridge comprises a plurality of ridges arranged parallel to one another.

8. A cutting element according to claim 1, wherein the at least one projection comprises at least one ridge, and wherein the at least one ridge comprises a plurality of ridges arranged in a star configuration.

9. A cutting element according to claim 1, wherein the working surface includes a planar end region and a peripheral side.

10. A cutting element according to claim 9, wherein a chamfer is formed between the end region and the peripheral side.

11. A cutting element according to claim 1, wherein the working surface includes a domed region.

12. A polycrystalline diamond cutting element comprising a plurality of partially bonded diamond crystals with interstices disposed therebetween and formed with a substrate of less hard material, the cutting element having a formation engaging working surface, the interstices adjacent to the working surface and to a first depth from the working surface being substantially free of the catalyzing material, the interstices remote from the working surface containing a catalyzing material, at least one tapering, substantially catalyst-free projection extending below the first depth to a second depth, the at least one projection being a distance from the working surface.

13. A cutting element according to claim 2, wherein the second depth is at least 0.5 times greater than the first depth.

14. A cutting element according to claim 2, wherein the first depth falls in the range of 0.05 mm to 0.5 mm.

15. A cutting element according to claim 2, wherein the second depth falls in the range of 0.1 mm to 1.0 mm.

16. A cutting element according to claim 2, wherein the at least one tapering projection comprises a plurality of projections.

* * * * *